US006755585B2

(12) United States Patent
Gueret

(10) Patent No.: US 6,755,585 B2
(45) Date of Patent: Jun. 29, 2004

(54) DEVICE AND METHOD FOR APPLYING A PRODUCT

(75) Inventor: Jean-Louis H. Gueret, Paris (FR)

(73) Assignee: L'Oreal S.A., Paris (FR)

( * ) Notice: Subject to any disclaimer, the term of this patent is extended or adjusted under 35 U.S.C. 154(b) by 0 days.

(21) Appl. No.: 10/232,518

(22) Filed: Sep. 3, 2002

(65) Prior Publication Data

US 2003/0075200 A1 Apr. 24, 2003

(30) Foreign Application Priority Data

Sep. 4, 2001 (FR) ..... 01 11422

(51) Int. Cl.[7] ..... A46B 11/00

(52) U.S. Cl. ..... 401/125; 401/123; 401/124; 132/317

(58) Field of Search ..... 401/206, 125, 401/123, 124, 202, 205, 207; 132/317

(56) References Cited

U.S. PATENT DOCUMENTS

| | | | | |
|---|---|---|---|---|
| 2,554,489 A | * | 5/1951 | Crane | 401/125 |
| 2,699,885 A | * | 1/1955 | McClure | 141/320 |
| 2,790,984 A | * | 5/1957 | Gilpin | 401/125 |
| 2,806,239 A | | 9/1957 | Wittnebert | |
| 3,038,193 A | | 6/1962 | Luedtke et al. | |
| 5,890,828 A | | 4/1999 | Gueret | |
| 5,945,076 A | | 8/1999 | Leonard et al. | |
| 6,334,727 B1 | | 1/2002 | Gueret | |

FOREIGN PATENT DOCUMENTS

| | | |
|---|---|---|
| EP | 1 044 625 | 10/2000 |
| FR | 2 792 296 | 10/2000 |

* cited by examiner

*Primary Examiner*—David J. Walczak
(74) *Attorney, Agent, or Firm*—Finnegan, Henderson, Farabow, Garrett & Dunner, LLP

(57) ABSTRACT

A device for applying a product may include a container configured to contain a product. The container may include an opening and a valve associated with the opening. The device may also include a structure configured to be removably fitted to the container, and the structure may include a closing element and a housing at least partially defined by the closing element. The housing may include at least one passage configured to provide flow communication between the container and the housing via the opening of the container when the structure is in a fitted position on the container. The structure may also include an applicator configured to be at least partially received in the housing. The device may be configured so that the valve is placed in an open position in response to fitting of the structure to the container.

46 Claims, 6 Drawing Sheets

Fig. 2A
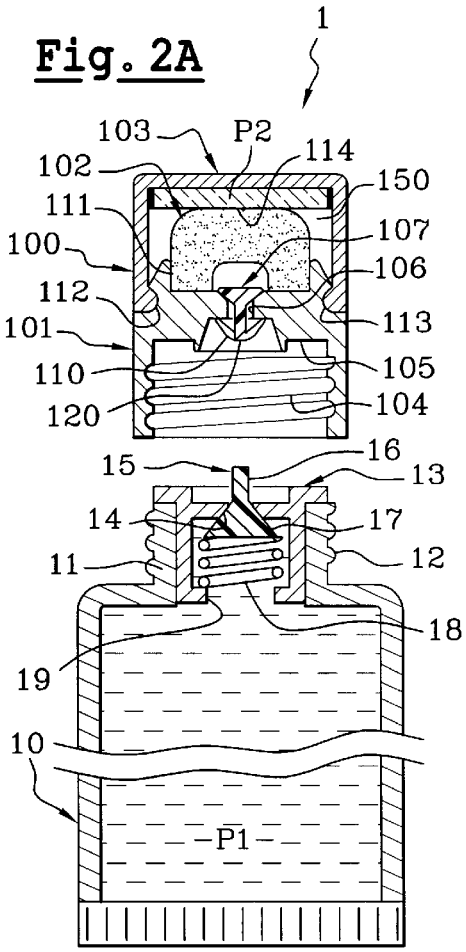
Fig. 2B
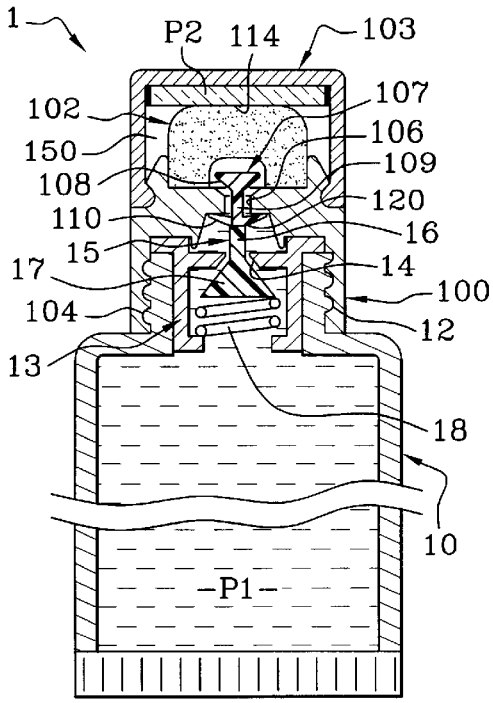
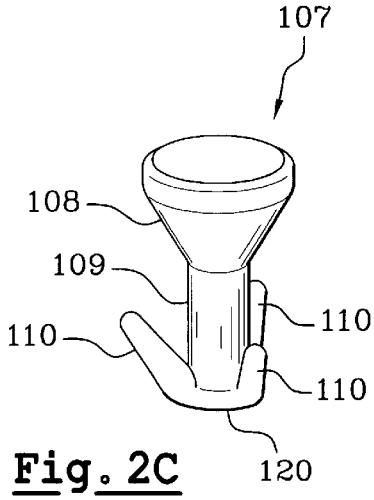
Fig. 2C

DEVICE AND METHOD FOR APPLYING A PRODUCT

The present invention relates to a device applying a product, for example, one or more cosmetic products.

In the field of cosmetic products, for example, one or more products may be provided in a container, which is beneath a housing that may communicate via one or more passages with an applicator received by the housing. The applicator may be integral with an element which closes an opening of the housing and which provides a structure for holding the applicator. The one or more passages may be equipped with a valve, for example, a flap valve, that opens in response to pressure from the product.

An example of one such device for applying a product is generally described in French patent application FR-A-2 792 296, which discloses an application assembly for applying one or more products, for example, to the skin and/or to the hair. The application assembly may include a container containing a first product and one or more applicator caps containing a second product. The applicator cap may include a support having a structure attaching it to the container while an applicator member is fitted to the support. The applicator cap may be designed to convey the first product from an orifice formed in the support to an application face of the application member. The application member may be covered by a removable cap fitted to the support and a second product may be received in the bottom of the removable cap in the form of a solid cake or a powder. The application surface may press elastically against the second product.

According to some embodiments disclosed in that document, a valve may be provided in the vicinity of the orifice in order to selectively open or close the orifice. The valve may be opened by the pressure of the product or by pressure exerted upon the application member when, for example, it contacts the surface to which the product is to be applied. The first product may be, for example, a make-up base in the form of a cream, a gel, or a milk. The second product may, for example, be in the form of a compressed or loose powder and may contain colored fillers or pigments. In some other embodiments, the first product may be a moisturizing and/or soothing base, for example, in the form of a milk or a cream. The second product may be in the form of, for example, a powder or a cream, and may contain a filter for protection against ultra-violet (UV) radiation. The disclosed application assembly, however, is not configured so that the valve is placed in an open condition in response to fitting structure (e.g., the applicator cap or its support) to the container.

Experience shows that when the applicator cap is equipped with a valve which is opened by pressing the application member on the surface to be treated, it may be difficult to apply the desired amount of product. Moreover, the pressure applied to the surface that is to be treated can, depending on the surface to be treated, make for uncomfortable application of the product. In addition, the valve may close automatically when the pressure is removed, which may prevent air being drawn back into the container. If the container is a flexible-walled tube, its shape may remain at least partly squashed following use, which may render it less attractive.

One subject of the invention relates to providing a device for applying one or more products that may include a container having a structure provided with an applicator that fully or partly obviates one or more of the drawbacks associated with the related art. Another subject of the invention relates to providing a device that may allow easy application of a desired amount of one or more products. A further subject of the invention relates to providing a device that may result in a more comfortable application of the product(s). Another subject of the invention relates to providing a device that may be simple and inexpensive to produce.

In the following description, certain aspects and embodiments will become evident. It should be understood that the invention, in its broadest sense, could be practiced without having one or more features of these aspects and embodiments. It should be understood that these embodiments are merely exemplary.

In one aspect, as embodied and broadly described herein, the invention includes a device for applying a product. The device may include a container configured to contain a product. The container may include an opening and a valve associated with the opening. The device may include a structure configured to be removably fitted to the container. The structure may include a closing element and a housing at least partially defined by the closing element. The housing may include at least one passage configured to provide flow communication between the container and the housing via the opening of the container when the structure is in a fitted position on the container. The structure may include an applicator configured to be at least partially received in the housing. The device may be configured so that the valve is placed in an open position in response to fitting of the structure to the container (e.g., the device may be configured to place the valve in an open position as a result of fitting the structure to the container, which is in contrast to the embodiment shown in FIG. 2 of FR-A-2 792 296, where a valve is not placed in an open position in response to fitting).

When the structure (e.g., a removable structure) is not fitted to the container, the product may be protected from the air without any auxiliary closing element such as a stopper or cap due, at least in part, to the presence of a valve in the opening of the container. The valve may be opened by fitting the structure to the container (and/or possibly closed by removing the structure). Since, in some embodiments, the product may be applied without exerting pressure on the skin, it may result in improved comfort when applying the product. When application of the product to the skin ceases, the valve may remain open. Thus, the valve may not prevent air from being drawn back into the container, and the container may maintain an attractive shape after use (e.g., the walls of an exemplary, flexible-walled container may not remain compressed).

According to another aspect, the valve may be configured to close via a return force when the structure is separated from the container. For example, the valve may include at least one elastically deformable portion configured to exert the return force. The valve may further include a movable valving element, wherein the movable valving element and the elastically deformable portion are integral with one another. For example, the movable valving element and the elastically deformable portion may be defined by a single piece, unitary construction (e.g., a construction molded from a single material, such as polyethylene, polypropylene, or another material). The elastically deformable portion may be configured to retain the movable valving element in the opening of the container. Some embodiments may include a spring (e.g., a helical spring), wherein the return force is exerted by the spring.

According to yet another aspect, the container may define a reservoir, and the valve may define a movable valving element configured to place the valve in the open position via displacement of the valving element toward the reservoir. This aspect may facilitate opening of the valve when the structure is fitted to the container.

In additional aspect, the device may include a member that is at least one of situated in the at least one passage of the housing and situated facing the at least one passage of the housing, wherein the member is configured to contact the valve when the structure is fitted to the container.

According to yet another aspect, the valve of the container may be a first valve, and the device may include a second valve associated with the at least one passage of the housing. According to this aspect, the structure may, for example, after loading the applicator with product, be removed from the container and placed in a handbag. The product retained in the structure may be sufficient for the user's requirements for a day or a weekend, for example. The presence of the second valve may ensure that the product cannot normally leak into the handbag.

In another aspect, the second valve may include a movable valving element configured to place the second valve in an open position via displacement of the valving element toward the housing. The second valve may be configured to be placed in an open position via pressure of a product exiting the container. For example, the second valve may include a flap valve element configured to bend via displacement toward the housing, and the second valve may be configured to resume a closed position via elastic memory (e.g., spring-back) as the pressure of a product exiting the container is reduced with an intake of air. Embodiments according to this aspect may be suitable when the container has variable volume, for example, when equipped with a piston and/or configured in the form of a flexible-walled tube.

In an additional aspect, the second valve may include a flap valve element configured to be displaced toward the housing via the pressure of the product exiting the container, and the second valve may be configured to resume a closed position via elastic memory as the pressure of a product exiting the container is reduced without an intake of air.

In still a further aspect, the device may be configured so that the second valve is placed in the open position in response to the fitting of the structure to the container. For example, the device may be configured so that when the structure is removably fitted to the container, a portion of the first valve contacts (e.g., engages) a portion of the second valve, thereby causing the first valve to be placed in its open position and the second valve to be placed in its open position. The second valve may be configured to close via an elastic return force (e.g., spring-back force) when the structure is separated from the container. The second valve may include a movable valving element and at least one elastically deformable portion integral with the movable valving element, and the return force may be exerted by the at least one elastically deformable portion. For example, the elastically deformable portion and movable valving element may be a single piece, unitary construction. The at least one elastically deformable portion may retain the valving element in the passage. In another example, the device may include a spring, wherein the return force may be exerted by the spring.

According to an additional aspect, the applicator may be integral with the closing element. For example, the applicator may be fitted to the closing element via at least one of adhesive bonding, welding, pinch fitting, and snap fitting. According to yet another aspect, the applicator may not be fixed to the housing.

In another aspect, the device may include a support configured to removably fit the structure to the container, wherein the support may be integral with the applicator and the passage of the housing may extend through the support. For example, the applicator may be fitted to the support via at least one of adhesive bonding, welding, pinch fitting, and snap fitting.

In still another aspect, the device may include a support, wherein the closing element may include a lid configured to be fitted to the support. The lid may include a bottom portion and the device may include an auxiliary product at least partially contained in the bottom portion of the lid. The device may be configured so that the applicator contacts the auxiliary product when the lid is fitted to the support. For example, the auxiliary product may include one of a compressed powder, a cream, and a gel. Alternatively, or in addition, the product contained in the container may be a moisturizing and/or soothing base and/or a make-up base, for example, in the form of a milk, a gel, or a cream. The auxiliary product may be in the form of, for example, a powder (compressed and/or loose) or a cream, and may contain a filter for protection against UV radiation and/or colored fillers and/or pigments.

According to some aspects, an application face of the applicator may be, at least before use, elastically compressed against an exposed surface of the auxiliary product contained in the lid. With some auxiliary products, this aspect may assist with loading the application face with a sufficient amount of the auxiliary product. According to some aspects, loading the application face with the auxiliary product may be at least assisted by twisting the application face (via twisting, for example, the application face with respect to the lid) as it presses against the exposed surface of the auxiliary product.

The auxiliary product may be poured (in either a hot condition or a cold condition), and/or compressed, directly into the bottom of the lid, and/or into a cup mounted in the bottom of the lid. Tabs and/or other gripping structures may be provided, for example, if the product is being poured into the lid, such that the auxiliary product may be able to be retained the bottom of the lid as it solidifies. If the auxiliary product is in the form of a loose powder or a cream, a mesh, an open-weave fabric and/or other retaining structure, for example, may be provided in order retain the auxiliary product in the bottom of the lid. The exposed surface of the auxiliary product may have any profile, such as, for example, a flat, a concave, or a convex profile. The auxiliary product may be separated from the bottom of the lid by an elastically compressible component, for example, a spring or a block of foam, or by a piston. This may reduce the compression of the applicator inside its housing, although, when the lid is closed, the applicator may be at least partially compressed (e.g., elastically).

In still another aspect, the applicator may include at least one material selected from elastically compressible materials, open-cell foams, and semi-open-cell foams, and the device may be configured so that the applicator is at least partially compressed elastically when an opening of the housing is closed.

According to some aspects, the application face of the applicator may be at least partially covered by flocking.

The applicator may comprise a block of absorbent material suitable for absorbing the product passing from the container. For example, when the applicator is mounted on the support, the applicator may convey product from the passage to the application face of the applicator. In exemplary embodiments including an absorbent applicator, for example, applicators including a felt, an open-cell foam, and/or a semi-open-cell foam, the applicator may include a plurality of "natural" passages formed between fibers of the flocking, or formed by the pores of the applicator's material. Such natural passages may be suitable, for example, when the product contained in the container is a liquid. In aspects including more viscous products, or in aspects including a substantially nonporous material, at least one "artificial" passage may be provided, for example, in the form of one or more channels (e.g., axial channels) extending from the support to the application face, to transport the product contained in the container to the application face.

The applicator may include an elastically compressible element (e.g., in the form of a bellows) having an application surface on its top. The applicator may include an application surface, for example, in the form of a foam, a fabric, and/or a non-woven fabric, and the application surface may include flocking. The application surface may be relatively smooth and/or be provided with a relief, for example, for providing a massaging action when the application surface contacts the skin.

According to an additional aspect, the applicator may include at least one material selected from polyurethane foams, polyester foams, polyether foams, PVC foams, NBR foams, felts, and multilayer composites.

In still another aspect, the container may include at least one rigid wall defining a reservoir portion of the container. For example, the at least one rigid wall may include glass.

In yet another aspect, the container may be configured to define a variable volume. Optionally, such a container may be configured to vary its volume in response to pressure applied to one or more of its portions. For example, the container may include a flexible-walled tube (e.g., wherein the variation in container volume is a result of pressure applied to one or more walls, perpendicular to its/their midplane). In another aspect the device may include a piston configured to slide inside the container so as to create a variation in volume. The piston may be configured to advance inside the container, for example, either in response to a depression inside the container or in response to pressure exerted manually on the piston.

According to a further aspect, the device may include a product contained in the container. For example, the product may include at least a portion of at least one of a cosmetic product and a care product. The product may include at least one of a liquid, a milk, a cream, and a gel.

According to an additional aspect, the device may include a refill structure including a product reservoir closed by a piston. The refill structure may be independent from the remainder of the assembly and may be configured to have a second housing (e.g., a housing containing an applicator) fitted onto the refill structure.

According to yet an additional aspect, the device may be configured so that the valve remains in the open position while the structure is fitted to the container. For example, the device may be configured so that the valve remains in the open position while the structure is fitted to the container regardless of axial force applied to the structure.

In still another aspect, the product in the container may not be pressurized (e.g., at least before a first use of the device).

In another aspect, the structure may be configured to be fitted to a portion of the container other than the valve.

According to an additional aspect, the container may define a reservoir, wherein the reservoir and at least a portion of the structure are substantially not axially movable with respect to one another when the housing is fitted to the container.

In an additional aspect, a method of applying a product may include providing the device for applying a product, fitting the structure to the container, wherein the valve is placed in an open position in response to the fitting of the structure to the container, and applying at least a portion of the product to a body portion using the applicator. In another aspect, the method may include removing the closing element from the remainder of the structure so as to expose the applicator. In still another aspect, the method may include removing the structure from the container. According to an additional aspect, the closing element may include an auxiliary product, and the method may include loading at least a portion of the applicator with at least a portion of the auxiliary product.

The term "providing" is used in a broad sense, and refers to, but is not limited to, making available for use, enabling usage, giving, supplying, obtaining, getting a hold of, acquiring, purchasing, selling, distributing, possessing, making ready for use, and/or placing in a position ready for use.

Aside from the structural and procedural arrangements set forth above, the invention could include a number of other arrangements, such as those explained hereinafter. It is to be understood, that both the foregoing description and the following description are exemplary.

The accompanying drawings are incorporated in and constitute a part of this specification. The drawings illustrate exemplary embodiments of the invention and, together with the description, serve to explain some principles of the invention. In the drawings, FIG. 1 is an exploded perspective view of an embodiment of a device for applying a product;

FIG. 2A is a schematic cross-section view of the device of FIG. 1 in a first condition;

FIG. 2B is a schematic cross-section view of the device of FIG. 1 in a second condition;

FIG. 2C is a perspective view of an embodiment of a valve element;

Reference will now be made in detail to some possible embodiments of the invention, examples of which are illustrated in the accompanying drawings. Wherever possible, the same reference numbers are used in the drawings and the description to refer to the same or like parts.

Figure 1:
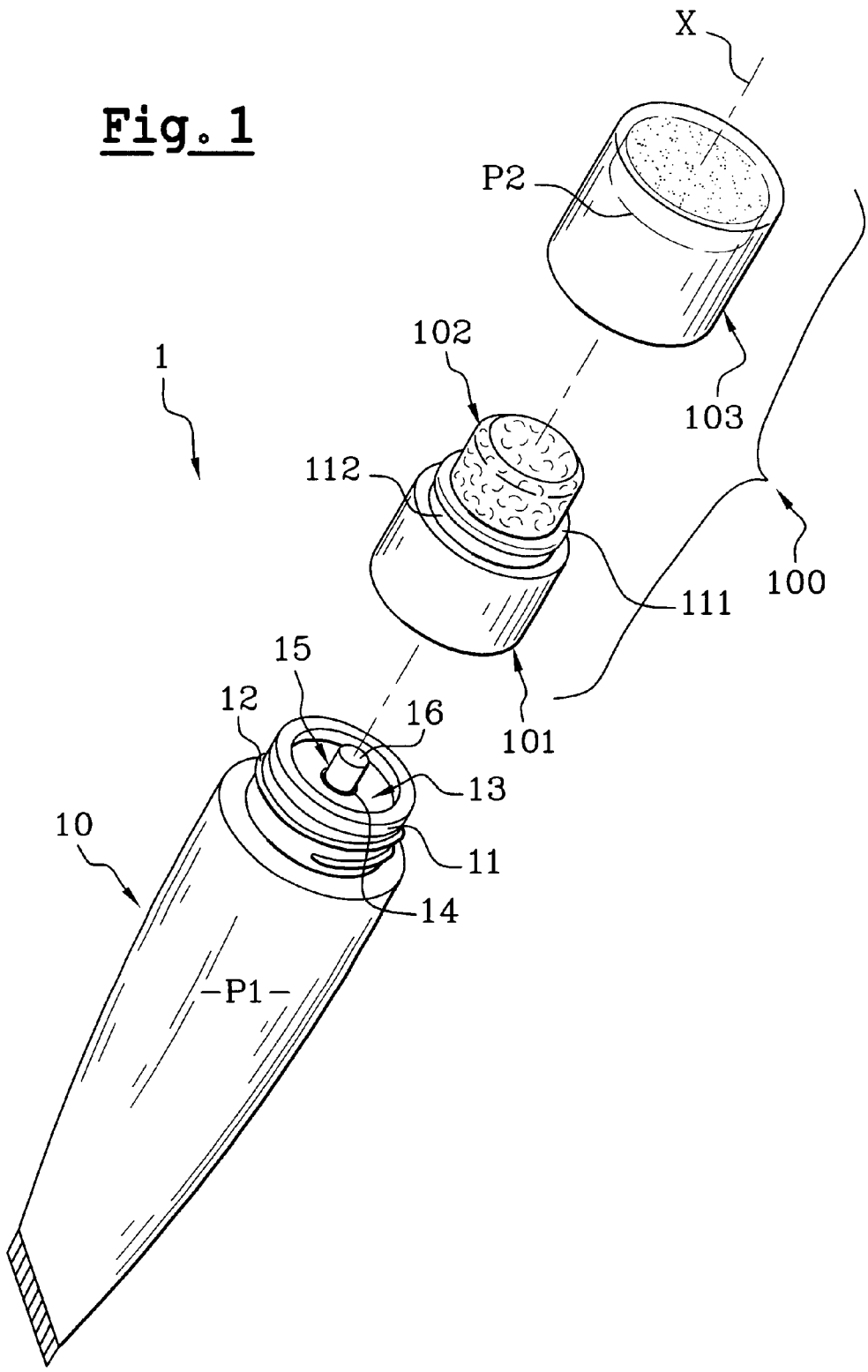

The embodiment of device 1 depicted in FIGS. 1 and 2A through 2C may have an axis X and may include a container 10 (e.g., a container in the form of a tube with flexible walls made of, for example, polyethylene). The container 10 may contain a product P1, for example, a milk configured to form a make-up base. The container 10 may be configured to accept a structured 100, for example, a removable structure, which will be described in greater detail below in relation to the description of the exemplary embodiment shown in FIGS. 2A through 2C.

In some embodiments, the structure 100 may include a support 101 which may be attached to the container 10 and may carry an applicator 102. The structure 100 may also include a lid 103 (e.g., a removable lid). The lid 103 may contain a product P2 (e.g., a product containing colored pigments) in the bottom of the lid 103.

The product P2 may be in the form of a solid cake produced by, for example, pouring (e.g., in either a hot condition or a cold condition) into the bottom of the lid 103, a liquid composition, for example, a composition having a plaster base, which solidifies as it cools. The product P2 may also be attached to the bottom of the lid 103 via a separate structure and/or a separate attaching mechanism.

As depicted FIGS. 2A through 2C, some embodiments of the device 1 may include a container 10 (e.g., a flexible-walled tube) which may include a neck 11 having a screw thread 12 on its outer surface. A member 13 inside the neck 11 may define an opening 14 (e.g., a central opening) having, for example, a frustoconical shape (i.e., a shape having a width that increases in portions of the opening closer to a reservoir portion of the container 10). The member 13 may be positioned in the neck 11 of the container 10 via snap-fitting, adhesive bonding, and/or tight fitting (i.e., dimensioning the member 13 and the neck 11 such that the member 13 is snugly received by the neck 13).

A valve element 15 may be provided at least partially within the opening 14 so as to define a valve. The valve element 15 may be configured to close the opening 14 when, for example, the structure 100 is not fitted to the container 10, as shown in FIG. 2A. Some embodiments of the valve element 15 may include a portion 16 (e.g., having a cylindrical shape) which may be narrower than the width of the opening 14. As shown in FIG. 2A, for example, the portion 16 emerges a few millimeters out of the container 10 via the opening 14. The valve element 15 may also include a closing portion 17 having, for example, a substantially conical profile that may substantially correspond to the exemplary frustoconical profile of the opening 14. As shown in FIG. 2A, for example, the valve element 15 may be biased toward a closed position via a spring 18 (e.g., a helical spring), one end of which may be engaged against the closing portion 17 while another end rests on a shoulder 19 (e.g., an annular shoulder) formed by the member 13.

The structure 100 may include a support 101 having a lateral skirt whose inner surface may include, for example, a screw thread 104 (or any other form of connecting structure) configured to mate with a screw thread 12 (or any other form of connecting structure) of the container 10. One end of the lateral skirt may be substantially closed by a wall 105 (e.g., a transverse wall) pierced by an axial passage 106 through its a central region. On the opposite side of the wall 105 from the container 10, the passage 106 may have a frustoconical configuration, for example, to form a seat for a valve element 107 (e.g., if the valve 107 has a corresponding frustoconical profile) of a valve associated with the structure 100.

In the exemplary embodiment depicted in FIG. 2C, the valve element 107 may include a closing portion 108 having, for example, a frustoconical profile that may correspond to an upper passage 106 that may also have a frustoconical profile. The valve element 107 may also include a connecting part 109 that may have a substantially cylindrical shape. At the opposite end from the closing portion 108, the connecting part 109 may terminate in an end portion 120. The closing portion 108 may be integral with end portion 120 which may include arms 110 (e.g., three inclined arms). In some embodiments, the arms 110 may be spaced at intervals of 120° and may project in a direction away from the bottom of the container 10 (i.e., as viewed when the valve element 107 is positioned within the upper passage 106). The valve element 107 may be molded from, for example, a low-density polyethylene, a thermoplastic, and/or a cross-linked elastomer.

In the condition (e.g., rest position) depicted in FIG. 2A, the arms 110 may elastically bias the closing portion 108 into a substantially leak-tight association with the passage 106. If, for example, pressure is exerted axially on the end portion 120 of the valve element 107 (as shown in FIG. 2B), the closing portion 108 may cease to be in a substantially leak-tight association with the upper passage 106. This may result in establishing, for example, an annular passage around the closing portion 108 of the valve element 107. As the pressure is removed, the arms 110 may return the valve element 107 to a substantially closed position, for example, via in an elastic manner.

On a side facing away from the lateral skirt, the wall 105 may be configured to receive an applicator 102. The applicator 102 may take the form of, for example, a block of open-cell and/or semi-open-cell foam. In some embodiments, the applicator 102 may be bonded to the wall 105 and may contain a hollowed-out portion in the vicinity of the valve element 107.

The applicator 102 may include a portion 111 (e.g., a lateral skirt portion) that may be provided with a groove 112 for snap-fit engagement with the lid 103 via, for example, a bead 113 that may be formed on an inner surface of the lateral skirt of the lid 103. The support 101 may be combined with the lid 103 and may define a substantially sealed housing 150 for the applicator 102.

A product P2 may be at least partially housed in the bottom of the lid 103 and may be in the form of, for example, a substantially solid cake containing colored pigments. With the lid 103 in a closed position, such as shown in FIG. 2B, an application surface 114 of the applicator 102 may be compressed (e.g., elastically) against an exposed surface of the product P2.

In some embodiments, the user may fit the structure 100 to the container 10. For example, he or she may engage the screw thread 104 of the structure 100 with the screw thread 12 of the container 10. As the screw threads 104 and 12 are engaged with each other, the portion 16 of the element valve 15 of the container 10 may contact the end portion 120 of the valve element 107 of the structure 100. This contact may open both the valve of the container and the valve of the structure, as shown in FIG. 2B.

The user may apply pressure to the walls of the container 10 which may cause a corresponding amount of product P1 to move from the container 10 to the applicator 102 contained inside the housing 150 via passages 14 and 106 (e.g., when the walls of the container 10 are flexible). As a result, the applicator 102 may become at least partially loaded with sufficient product P1 for the user's requirements for, for example, a day or a weekend.

The user may then separate the structure 100 from the container 10, for example, by unscrewing it. This may result in the valve elements 15 and 107 ceasing to be in mutual contact and the valve element 15 of the container 100 may close due to a biasing action of, for example, a spring 18.

The valve element 107 of the structure 100 may close due to the return force of, for example, the arms 110.

In some embodiments, to apply the product, the user may twist the lid 103 on the structure 100 which may generate friction between the application surface 114 (which may be at least partially loaded with product P1) and the exposed surface of product P2 so as to remove at least a portion of product P2 and transfer it to the application surface 114 of the applicator 102. The user may remove the lid 103 and, by holding the applicator 102 by the support 101, for example, may move the application surface 114 over the surface to be treated (e.g., the skin and/or hair). As a result, the user may deposit a composition including portions of product P1 (e.g., a make-up base) optionally mixed with portions of product P2 (e.g., colored pigments). After moving the application surface 114 over the surface to be treated, the user may re-fit the lid 103 to the structure 100 and may place the structure 100 in, for example, a handbag or a carry-all. After using up the contents of the structure 100, the structure 100 may be refilled in the manner discussed above.

Figure 3A:
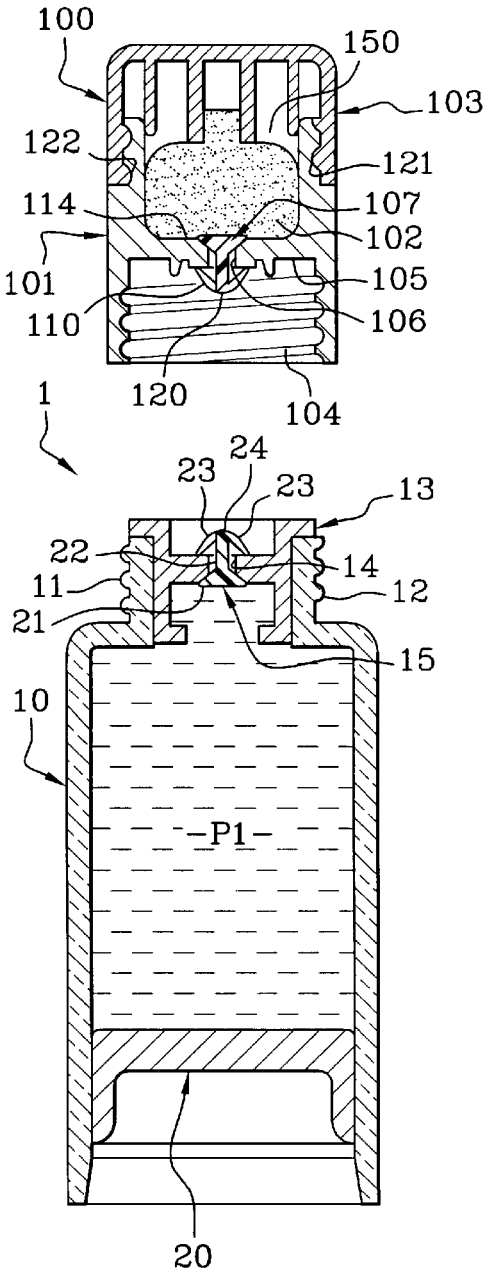
FIG. 3A is a schematic cross-section view of another embodiment of a device for applying a product in a first condition.
Figure 3B:
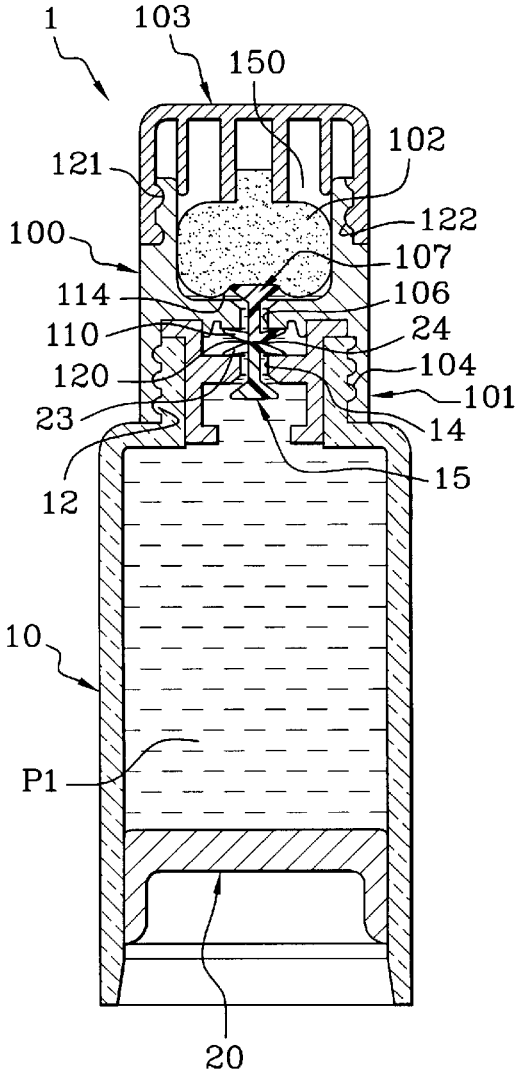
FIG. 3B is a schematic cross-section view of the device of FIG. 3A in a second condition.

FIGS. 3A and 3B depict another exemplary embodiment that may include a container 10, for example, a bottle (e.g., a cylindrical bottle) having substantially rigid walls. The container may be formed from, for example, polypropylene, and may include a piston 20 configured to move inside the container 10. The container 10 may include a valve element 15 that may be similar to a valve element 107 that may be fitted in an orifice 106 of the structure 100. The two valve elements 15 and 107 may be oriented in opposite directions. For example, the valve element 15 may include a closing portion 21 that may have a frustoconical profile and may substantially correspond to the profile of at least a portion of the orifice 14. The valve element 15 may include a connecting part 22 that may have a substantially cylindrical shape. At an end of the connecting part 22 that may be opposite the closing portion 21, the connecting part 22 may terminate in an end portion 24 and may be integral with arms 23 (e.g., three inclined arms spaced at, for example, 120° intervals). The arms 23 may be oriented such that they extend at least slightly toward the bottom of the container 10 (e.g., when the valve 15 is positioned in the orifice 14). When closed, the closing portion 21 of the valve 15 may be received in the orifice 14 (e.g., in a frustoconical part) in a substantially leak-tight manner due to a return force in arms 23 (i.e., in embodiments having arms 23).

The applicator 102 may be integral with the lid 103, and the lid 103 may include screw threads 121 that may be fitted to screw threads 122 of a support 101. When the removable lid 103 is fitted to the support 101, the applicator 102 may be at least partially compressed, for example, in an axial direction. The force resulting from the compression of the applicator 102 may be weaker than the force required to close the valve element 107.

The device according some embodiments may be configured to apply only a single product P1 contained in the container 10 (e.g., a liquid foundation). To use the device 1 according to these exemplary embodiments, a user may fit the structure 100 to the container 10. For example, the user may engage the screw threads 104 of the structure 100 with the screw threads 12 of the container 10. As the screw threads 104 and 12 become engaged with each other, the end portion 24 of the valve element 15 of the container 10 may contact (e.g., in an axial manner) the end portion 120 of the valve element 107 of the structure 100. This contact may open both the valve element 15 and the valve element 107, as shown in FIG. 3B.

The user may then apply pressure to a piston 20 of the container 10 with his or her thumb. The pressure may causes a corresponding amount of product P1 to move from the container 10 into the applicator 102 received by the housing 150 via the passages 14 and 106. The applicator 102 may be loaded with product P1 and may retain be sufficient for the user's requirements (e.g., for one day or one weekend). The user may optionally separate the structure 100 from the container 10 by, for example, unscrewing it. As a result of the structure 100 being separated from the container 10, the valve elements 15 and 107 may become separated from each other. The valve element 15 of the container 10 may close the orifice 14 due to the return force, for example, of the arms 23. The valve element 107 of the structure 100 may closes due to the return force, for example, of the arms 110.

To apply the product P1, the user may remove the lid 103 (e.g., via unscrewing). During removal, the applicator 102 may decompress and produce a pumping action of at least some of product P1 located, for example, in the bottom of the housing 150. He or she may then hold the applicator 102, for example, by the removable lid 103 and move the application surface 114 over the surface to be treated. This action deposits the product P1 on the surface to be treated. After application, the user may close the lid 103, thereby repositioning the applicator 102 in the housing 150. The user may then place the structure 100 into a handbag or carry-all. In some embodiments, the user may refill the structure 100 as described above.

Figure 4A:
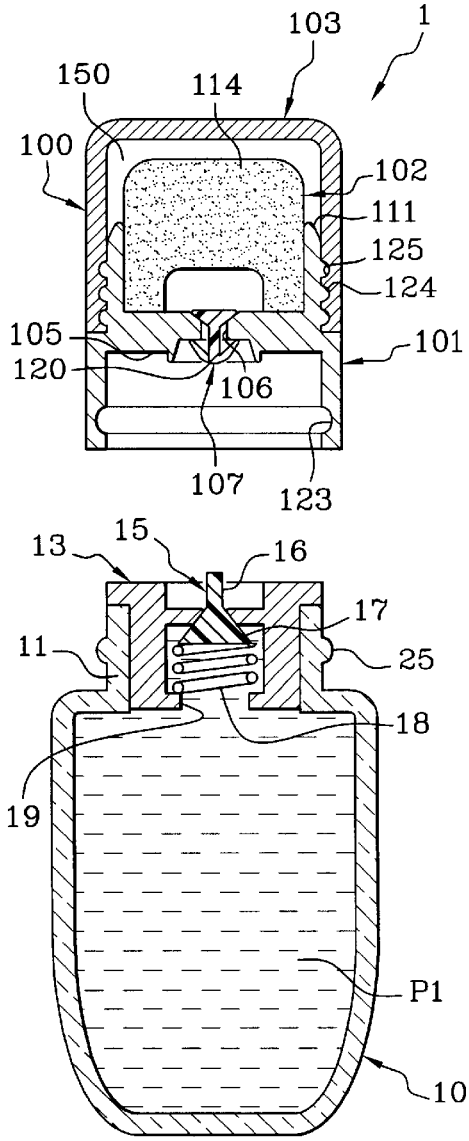
FIG. 4A is a schematic cross-section view of a further embodiment of a device for applying a product in a first condition.
Figure 4B:
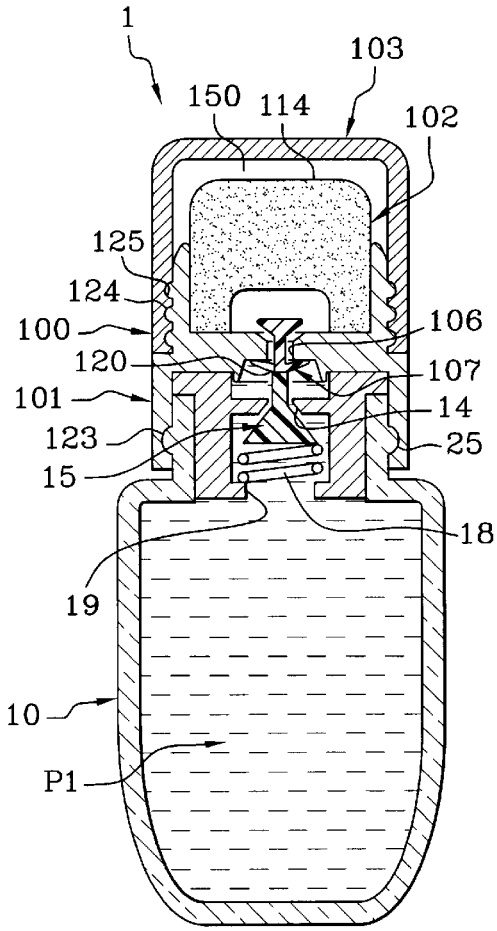
FIG. 4B is a schematic cross-section view of the device of FIG. 4A in a second condition.

FIGS. 4A and 4B depict another embodiment of a device 1 of applying a product. The device 1 depicted in FIGS. 4A and 4B may include a glass container 10 and a product P1 which contains is a product, for example, a care product, having viscosity is similar to that of water.

The device 1 according to some embodiments may be intended for applying only the product P1 contained in the container 10. The structure 100 may be, for example, snap-fitted onto the container 10 via bead 25 on the outer surface of the neck 11 of the container 10. The bead 25 may engage with a groove 123 on an inner surface of a lateral skirt of the support 101 of the structure 100. A lid 103 may be threaded onto the support 101 via screw threads 124 and 125 of the support 101 and the lid 103, respectively.

The embodiment depicted in FIGS. 4A and 4B may be substantially similar in many aspects to the embodiment depicted in FIGS. 2A and 2B. For example, the embodiment in FIGS. 4A and 4B operates in a similar manner to the embodiment shown in FIGS. 2A and 2B. Due to the low viscosity of the exemplary product P1 that may be used in association with the embodiment shown in FIGS. 4A and 4B, however, the product P1 may be supplied to the applicator 102, for example, by simply shaking the device 1 prior to use while the structure 100 is fitted to the container 10. In this exemplary fashion, at least a portion of the product P1 may be supplied to the application surface 114 via the passages 14 and 106, for example, via capillary action. During use, the user's hand movements may be substantially similar to those associated with the embodiment shown in FIGS. 2A and 2B, for example, with the product P1 being applied without prior contact with an auxiliary product P2.

Figure 5A:
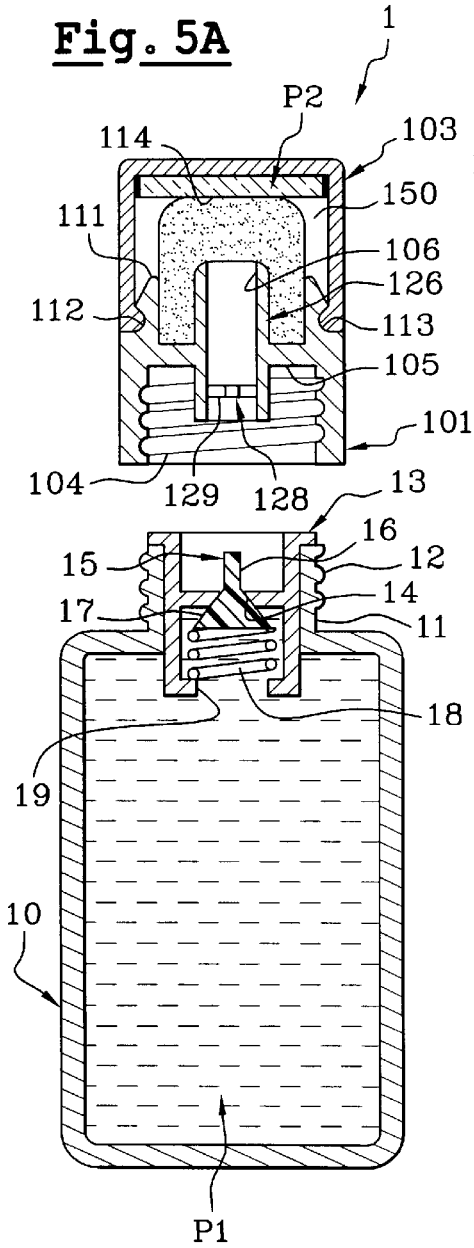
FIG. 5A is a schematic cross-section view of another embodiment of a device for applying a product in a first condition.
Figure 5B:
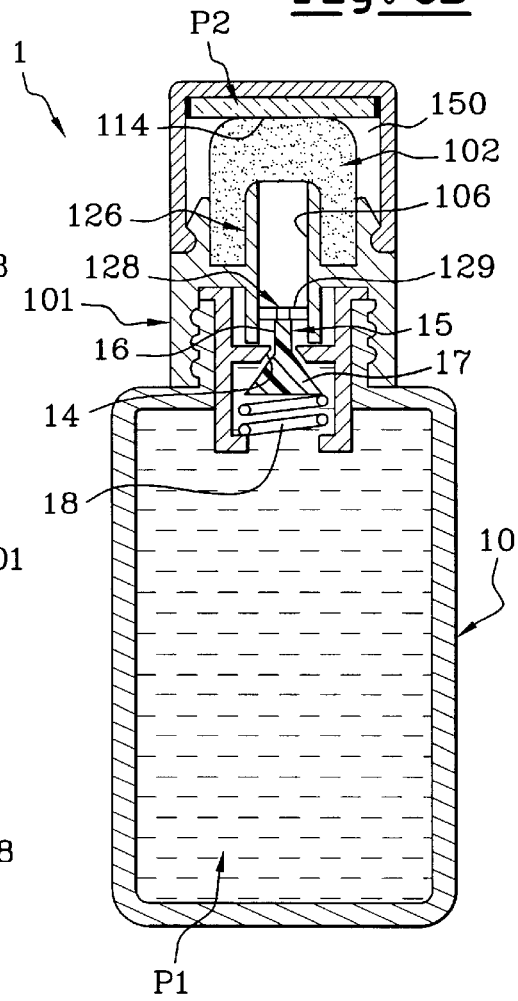
FIG. 5B is a schematic cross-section view of the device of FIG. 5A in a second condition.
Figure 5C:
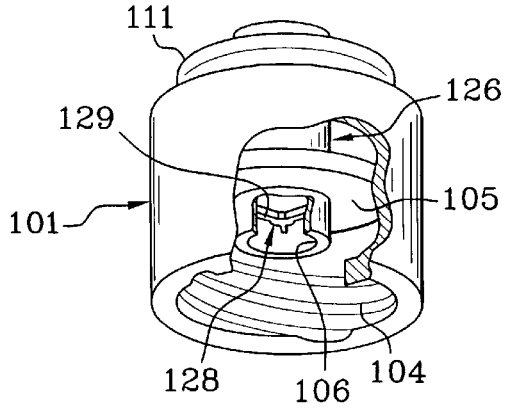
FIG. 5C is a perspective, partial section view of an embodiment of a support.

FIGS. 5A through 5C depict an additional embodiment of a device 1 for applying a product. In that embodiment, the device 1 may include a container 10 having rigid walls (e.g., walls formed of polypropylene). The product P1 may contain, for example, a moisturizing product having a viscosity similar to that of water. The applicator structure 100 may differ from the embodiment depicted in FIGS. 2A and 2B, for example, by virtue of its support 101, as shown in FIG. 5C.

In this exemplary embodiment, the wall 105 (e.g., a transverse wall) of the support 101 may contain at least one channel 126 (e.g., an axial channel) that may define a passage 106 for the housing 150. In the vicinity of its lower end, the channel 126 may include a perforated wall 128 formed, for example, by three arms 129 spaced out at intervals (e.g., intervals of 120°) and may meet in a relatively central region of the channel 126. The structure 100 may not include a valve in the passage 106. The lid 103 may receive a product P2 which may include a solid composition containing, for example, compounds for protection against UV radiation from the sun.

To use the device 1 according to the embodiment shown in FIGS. 5A through 5C, the user may fit the structure 100 to the container 10. For example, the user may fit the exemplary screw thread 104 of the structure 100 on the screw thread 12 of the container 10. As the structure 100 is fitted to the container 10, a relatively central portion of the perforated wall 128 of the support 101 contacts the portion 16 of the valve element 15 of the container 10 in a manner that may push open the valve element 15, as shown in FIG. 5B.

The user may then shake the device 1 which may cause at least a portion of the product P1 to move, for example, via by capillary action, from the container 10 to the applicator 102 received by the housing 150, through the orifices 14 and 106. As a result, the applicator 102 may be loaded with product P1. The user may then separate the structure 100 from the container 10, for example, by unscrewing it. As the user separates the structure from the container, the perforated wall 128 of the support 101 may separate from the valve element 15 which may close via a return force from an exemplary spring 18.

To apply the product P1, the user may twist the removable lid 103 on the structure 100, for example, to generate friction between the application surface 114 (which may be substantially loaded with product P1) and the exposed surface of the product P2 so as to rub off at least a portion of the product P2 and transfer it to the application surface 114 of the applicator 102. The user may then open the lid 103 and, for example, holding the applicator 102 by the support 101, may move the application surface 114 over the surface to be treated. In the process, the user may deposit a composition including a combination of products P1 and P2, for example, a combination of moisturizing base and sunscreen, on the surface to be treated.

After application, the user may fit the lid 103 to the structure 100 and may fit the structure 100 to the container 10. This exemplary embodiment may be used in association with relatively large capacity containers of product that may be difficult to apply when applying, for example, a combination of product P1 and product P2.

Figure 6A:
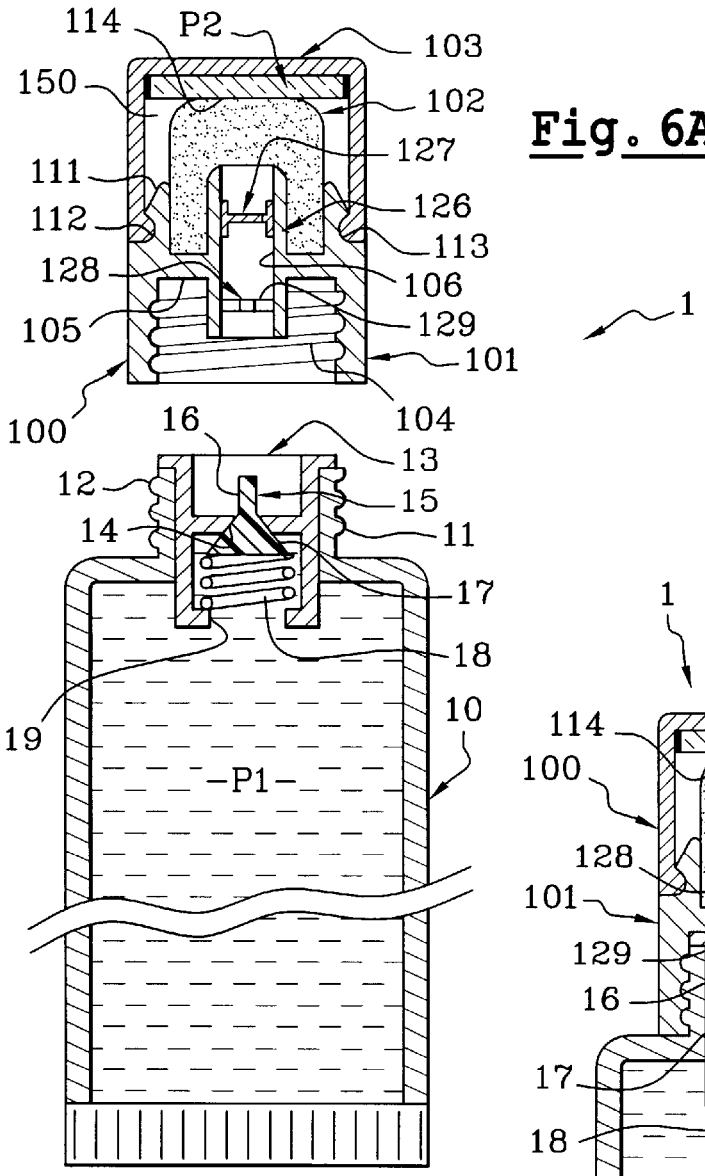
FIG. 6A is a schematic cross-section view of a further embodiment of a device for applying a product in a first condition.
Figure 6B:
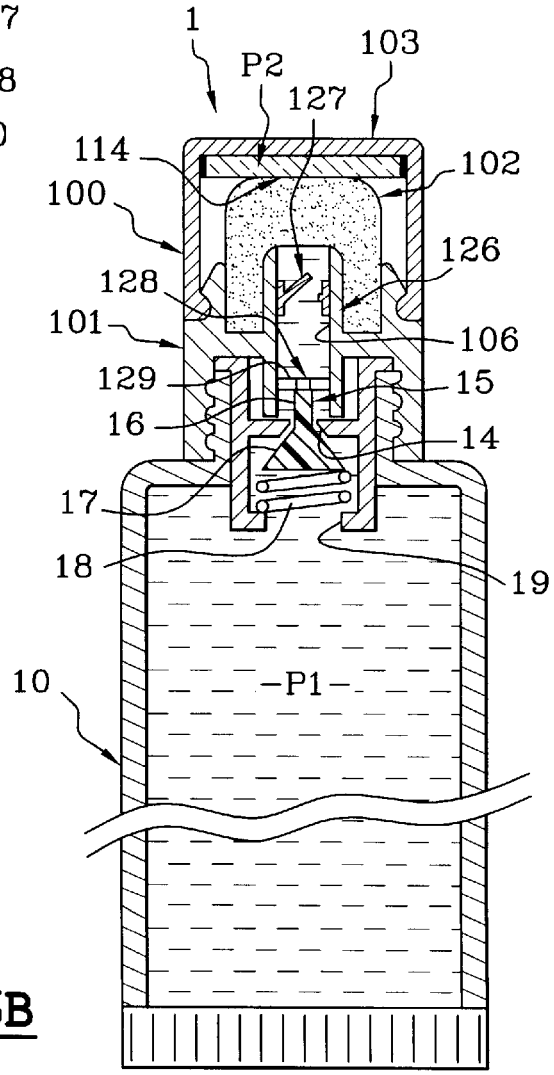
FIG. 6B is a schematic cross-section view of the device of FIG. 6A in a second condition.

FIGS. 6A and 6B depict an exemplary embodiment of a device 1 that may include a container 10 which may have flexible walls (e.g., walls formed from polyethylene). The container 10 may contain a product P1 that may be relatively viscous (e.g., more viscous than, for example, water). The device 1 may include a flap valve 127 (e.g., an overmolded elastomeric flap valve) in the vicinity of the upper end of the channel 126. The flap valve 127 may be configured to open under the pressure of the product P1 moving along the passage 106, and may close via, for example, a return force when the pressure of the product P1 is removed. The flap valve 127 may be configured to allow air to be drawn in when it closes. Alternatively, a rigid seat may be provided to prevent air from being drawn in.

The operation of the device according to the embodiment shown in FIGS. 6A and 6B may be similar to that of some of the previously mentioned embodiments except that the movement of product P1 from the container 10 to the housing 150 may occur, for example, via pressure on the walls of the container 10 (e.g., flexible walls). After the structure 100 is used, it may be carried independently of the container 10 with little or no risk of accidental leakage, for example, in a handbag, because of the presence of the flap valve 127.

In the above detailed description, reference was made to exemplary embodiments of the invention. Obviously, variations may be made thereto without departing from the spirit of the invention as claimed below.

In particular, the shape of the applicator may be different from the shape illustrated with reference to the embodiments just described. Generally speaking, the shape of the applicator is chosen as a function of the zone to be treated. For example, in the case of an applicator for the lips, use will be made, for example, of an applicator substantially in the shape of a cone.

The device according to some exemplary embodiments of the invention may be used to apply cosmetic products, such as care products, make-up products, perfumes, colognes, dermatological substances, and/or pharmaceutical compositions used for treating and/or changing the appearance and/or scent of hair or skin. However, in its broadest aspects, the present invention could be used to apply many other substances.

Furthermore, sizes of various structural parts and materials used to make the above-mentioned parts are illustrative and exemplary only, and one of ordinary skill in the art would recognize that these sizes and materials can be changed as necessary to produce different effects or desired characteristics.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. A device for applying a product, the device comprising:

a container configured to contain a product, the container comprising an opening and a valve associated with the opening; and a structure configured to be removably fitted to the container, wherein the structure comprises a closing element, a housing at least partially defined by the closing element, the housing comprising at least one passage configured to provide flow communication between the container and the housing via the opening of the container when the structure is in a fitted position on the container, and an applicator configured to be at least partially received in the housing, wherein the device is configured so that the valve is placed in an open position in response to fitting of the structure to the container.

2. The device of claim 1, wherein the valve is configured to close via a return force when the structure is separated from the container.

3. The device of claim 2, wherein the valve comprises at least one elastically deformable portion configured to exert the return force.

4. The device of claim 3, wherein the valve further comprises a movable valving element, and wherein the movable valving element and the elastically deformable portion are integral with one another.

5. The device of claim 4, wherein the movable valving element and the elastically deformable portion are defined by a single piece, unitary construction.

6. The device of claim 3, wherein the elastically deformable portion is configured to retain the movable valving element in the opening of the container.

7. The device of claim 2, further comprising a spring, wherein the return force is exerted by the spring.

8. The device of claim 1, wherein the container defines a reservoir, and wherein the valve comprises a movable valving element configured to place the valve in the open position via displacement of the movable valving element toward the reservoir.

9. The device of claim 8, further comprising a member that is at least one of situated in the at least one passage of the housing and situated facing the at least one passage of the housing, wherein the member is configured to contact the valve when the structure is fitted to the container.

10. The device of claim 1, wherein the valve of the container is a first valve, and wherein the device further comprises a second valve associated with the at least one passage of the housing.

11. The device of claim 10, wherein the second valve comprises a movable valving element configured to place the second valve in an open position via displacement of the movable valving element toward the housing.

12. The device of claim 10, wherein the second valve is configured to be placed in an open position via pressure of a product exiting the container.

13. The device of claim 12, wherein the second valve comprises a flap valve element configured to bend via displacement toward the housing, and wherein the second valve is configured to resume a closed position via elastic memory as the pressure of a product exiting the container is reduced with an intake of air.

14. The device of claim 12, wherein the second valve comprises a flap valve element configured to be displaced toward the housing via the pressure of the product exiting the container, and wherein the second valve is configured to resume a closed position via elastic memory as the pressure of a product exiting the container is reduced without an intake of air.

15. The device of claim 10, wherein the device is configured so that the second valve is placed in the open position in response to the fitting of the structure to the container.

16. The device of claim 15, wherein the device is configured so that when the structure is removably fitted to the container, a portion of the first valve contacts a portion of the second valve, thereby causing the first valve to be placed in its open position and the second valve to be placed in its open position.

17. The device of claim 15, wherein the second valve is configured to close via an elastic return force when the structure is separated from the container.

18. The device of claim 17, wherein the second valve comprises a movable valving element and at least one elastically deformable portion integral with the movable valving element, and wherein the return force is exerted by the at least one elastically deformable portion.

19. The device of claim 18, wherein the at least one elastically deformable portion retains the valving element in the passage.

20. The device of claim 17, further comprising a spring, wherein the return force is exerted by the spring.

21. The device of claim 1, wherein the applicator is integral with the closing element.

22. The device of claim 21, wherein the applicator is fitted to the closing element via at least one of adhesive bonding, welding, pinch fitting, and snap fitting.

23. The device of claim 1, further comprising a support configured to removably fit the structure to the container, wherein the support is integral with the applicator and the passage of the housing extends through the support.

24. The device of claim 23, wherein the applicator is fitted to the support via at least one of adhesive bonding, welding, pinch fitting, and snap fitting.

25. The device of claim 1, wherein the applicator is not fixed to the housing.

26. The device of claim 1, further comprising a support, wherein the closing element comprises a lid configured to be fitted to the support, the lid comprising a bottom portion, and wherein the device further comprises an auxiliary product at least partially contained in the bottom portion of the lid, the device being configured so that the applicator contacts the auxiliary product when the lid is fitted to the support.

27. The device of claim 26, wherein the auxiliary product comprises one of a compressed powder, a cream, and a gel.

28. The device of claim 1, wherein the applicator comprises at least one material selected from elastically compressible materials, open-cell foams, and semi-open-cell foams, and wherein the device is configured so that the applicator is at least partially compressed elastically when an opening of the housing is closed.

29. The device of claim 28, wherein the applicator comprises at least one material selected from polyurethane foams, polyester foams, polyether foams, PVC foams, NBR foams, felts, and multilayer composites.

30. The device of claim 1, wherein the container comprises at least one rigid wall defining a reservoir portion of the container.

31. The device of claim 30, wherein the at least one rigid wall comprises glass.

32. The device of claim 1, wherein the container is configured to define a variable volume.

33. The device of claim 32, wherein the container comprises a flexible-walled tube.

34. The device of claim 32, further comprising a piston configured to slide inside the container.

35. The device of claim 1, further comprising a product contained in the container.

36. The device of claim 35, wherein the product in the container is not pressurized.

37. A method for applying a product comprising:

providing the device of claim 35;

fitting the structure to the container, wherein the valve is placed in an open position in response to the fitting of the structure to the container; and applying at least a portion of the product to a body portion using the applicator.

38. The method of claim 37, further comprising removing the closing element from the remainder of the structure so as to expose the applicator.

39. The method of claim 38, further comprising removing the structure from the container.

40. The method of claim 37, wherein the closing element comprises an auxiliary product, and wherein the method further comprises loading at least a portion of the applicator with at least a portion of the auxiliary product.

41. The device of claim 35, wherein the product comprises at least a portion of a cosmetic product.

42. The device of claim 41, wherein the product comprises at least one of a liquid, a milk, a cream, and a gel.

43. The device of claim 1, wherein the device is configured so that the valve remains in the open position while the structure is fitted to the container.

44. The device of claim 43, wherein the device is configured so that the valve remains in the open position while the structure is fitted to the container regardless of axial force applied to the structure.

45. The device of claim 1, wherein the structure is configured to be fitted to a portion of the container other than the valve.

46. The device of claim 1, wherein the container defines a reservoir, wherein the reservoir and at least a portion of the structure are substantially not axially movable with respect to one another when the housing is fitted to the container.

* * * * *